US006015973A

United States Patent [19]

Nunome

[11] Patent Number: 6,015,973

[45] Date of Patent: Jan. 18, 2000

[54] ENERGY FILTER

[75] Inventor: Hiromi Nunome, Tokyo, Japan

[73] Assignee: JEOL Ltd., Tokyo, Japan

[21] Appl. No.: 08/951,247

[22] Filed: Oct. 16, 1997

[30] Foreign Application Priority Data

Oct. 16, 1996 [JP] Japan ..... 8-273422

[51] Int. Cl.[7] ..... H01J 49/44

[52] U.S. Cl. ..... 250/305; 250/396 ML

[58] Field of Search ..... 250/305, 396 ML

[56] References Cited

U.S. PATENT DOCUMENTS

| | | | |
|---|---|---|---|
| 4,740,704 | 4/1988 | Rose et al. | 250/396 |
| 5,126,565 | 6/1992 | Rose | 250/305 |
| 5,177,361 | 1/1993 | Krahl et al. | 250/305 |
| 5,449,914 | 9/1995 | Rose et al. | 250/396 |
| 5,585,630 | 12/1996 | Taniguchi et al. | 250/311 |

OTHER PUBLICATIONS

"High–Resolution imaging magnetic energy filters with simple structure", S. Lanio, *Optik*, 73, No. 3 (1986), pp. 99–107.

*Primary Examiner*—Jack I. Berman
*Attorney, Agent, or Firm*—Webb Ziesenheim Logsdon Orkin & Hanson, P.C.

[57] ABSTRACT

There is disclosed an energy filter having polepieces which form lenses and are mounted at accuracies that can be easily checked. The positions of the lenses can be easily readjusted. The lenses are mounted to a base plate and stacked on top of each other between two polepieces via two spacers. The polepieces form magnetic poles. These lenses are mounted to the base plate with screws so as to form a passage.

4 Claims, 3 Drawing Sheets

ENERGY FILTER

FIELD OF THE INVENTION

The present invention relates to an energy filter incorporated in a transmission electron microscope to analyze the energies of the electron beam or the like.

BACKGROUND OF THE INVENTION

An energy filter for forming an image is also known as an electron filter, energy filter, or electron spectrometer and used in a transmission electron microscope. The contrast between a pair of imaging portions is improved by selecting electrons lying in a given energy range. Also, an image representing the distribution of elements and a filtered-electron diffraction graph can be recorded. An omega filter is disclosed in U.S. Pat. No. 5,177,361. A gamma filter is disclosed in U.S. Pat. No. 5,585,630.

FIGS. 3(A) and 3(B) show an example of the structure of the omega filter described in the above-cited U.S. Pat. No. 5,177,361. This omega filter is a kind of energy filter. FIG. 3(A) is a cross-sectional view taken on line B—B of FIG. 3(B). FIG. 3(B) is a cross-sectional view taken on line A—A of FIG. 3(A). The omega filter, generally indicated by numeral 1, has two outer yokes 3 and 4. A center yoke 2 is held between these two outer yokes 3 and 4 and provided with a passage 6 shaped like the letter "Q". An electron beam, indicated by 5*a* or 5*b*, passes through this passage 6. The two outer yokes 3 and 4 are mounted to the center yoke 2 with bolts 7. Polepieces 8 are firmly mounted to the outer yokes 3 and 4 with bolts 9 and located opposite to four deflection positions along the passage 6. A coil 10 for producing an electromagnetic field is wound around each polepiece 8, thus forming lenses for the omega filter 1. The incident electron beam 5*a* is deflected by the action of the four lenses, travels in the substantially Q-shaped passage 6, and emerges as the electron beam 5*b* on the same straight line as the incident electron beam 5*a*.

Maintaining the desired dimensional accuracy of the length L of the gap between the opposite polepieces 8 shown in FIG. 3(A) is important for the performance of the omega filter. Also, the desired dimensional accuracy of the angle of the incident surface 8*a* of each polepiece 8 and the angle of the exit surface 8*b* shown in FIG. 3(B) must be maintained. Furthermore, the incident surface 8*a* and the exit surface 8*b* of each polepiece 8 which are opposite to each other should be prevented from being misaligned.

In this conventional omega filter 1, one polepiece 8 is mounted on each of the two outer yokes 3 and 4, together with one coil 10. These outer yokes 3 and 4 are mounted on the center yoke 2, thus forming a three-layered structure. This makes it impossible to check the dimensional accuracies during and after assembly. Moreover, the positions of the individual lenses cannot be readjusted.

SUMMARY OF THE INVENTION

The present invention is intended to solve the foregoing problems.

It is an object of the present invention to provide an energy filter having polepieces which form lenses and are mounted at accuracies that can be easily checked, the lenses being mounted at locations that can be readily readjusted.

This object is achieved in accordance with the teachings of the invention by an energy filter comprising a base plate and lenses mounted on the base plate and stacked on top of each other between two polepieces via two spacers. These polepieces form magnetic poles. The lenses are mounted on the base plate with screws such that a passage is formed between the two spacers.

Other objects and features of the invention will appear in the course of the description thereof, which follows.

DETAILED DESCRIPTION OF THE INVENTION

Figure 1:
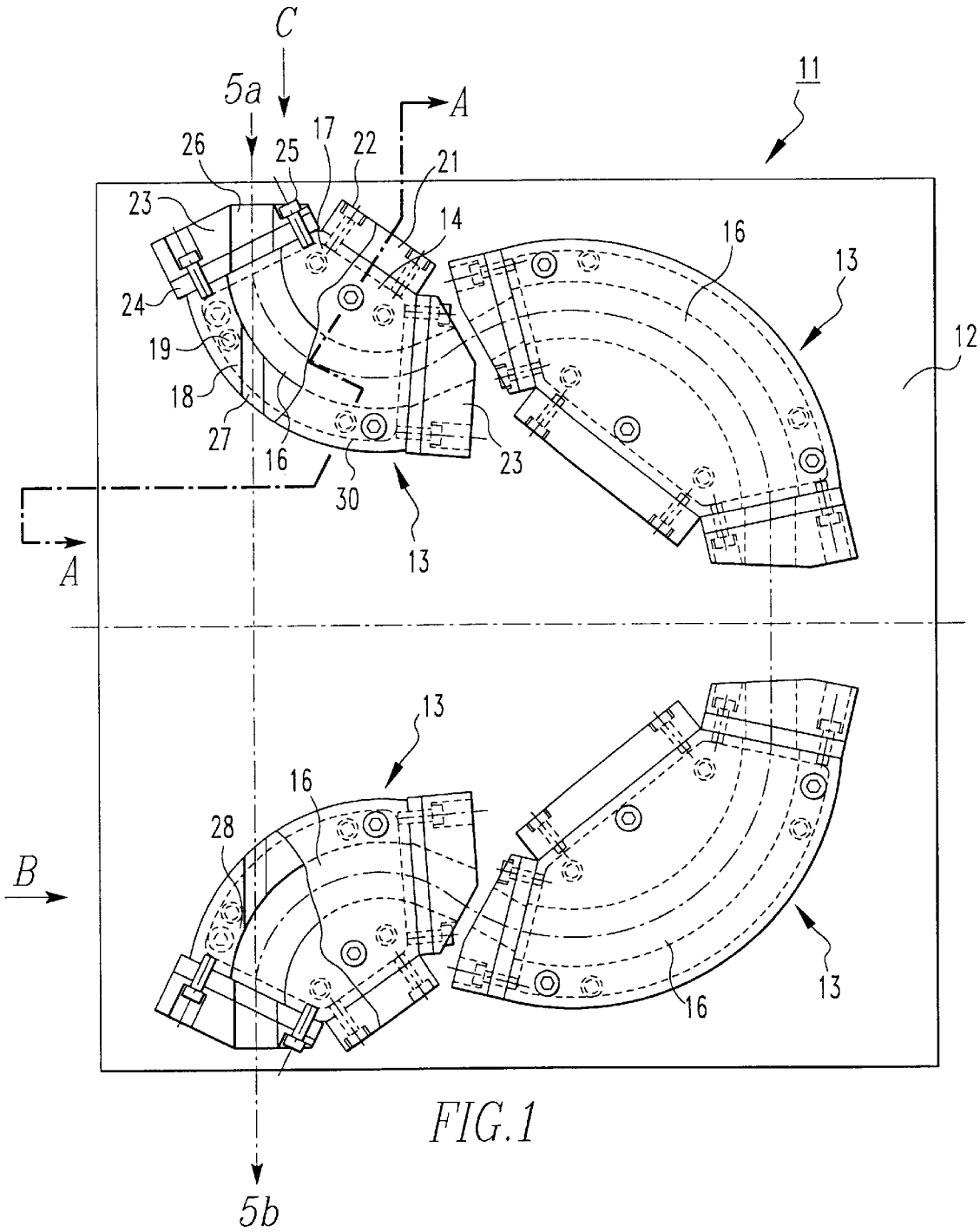
FIG. 1 is a plan view of an omega filter in accordance with the present invention.
Figure 2A:
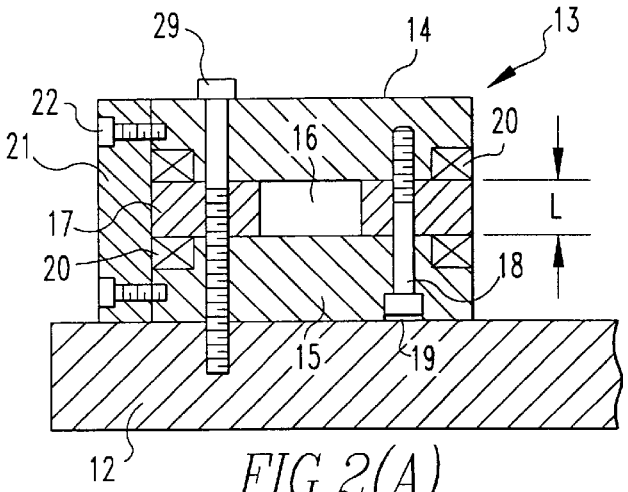
FIG. 2(A) is a cross-sectional view taken along line A—A of FIG. 1.
Figure 2B:
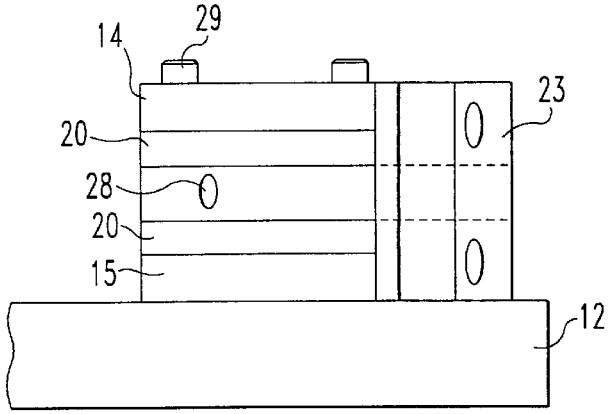
FIG. 2(B) is a side elevation taken in the direction indicated by the arrow B of FIG. 1.
Figure 2C:
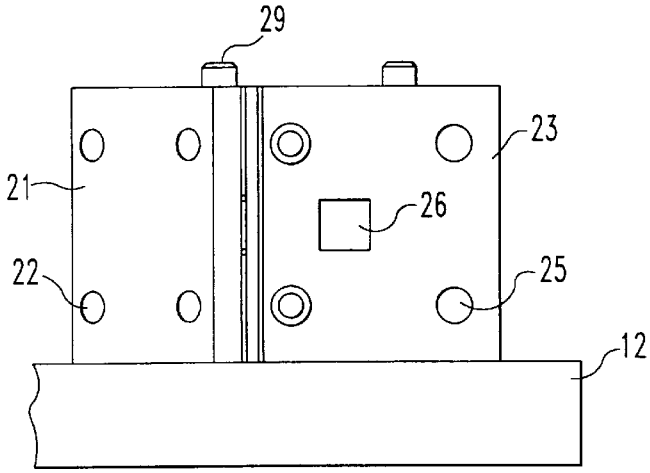
FIG. 2(C) is a side elevation taken in the direction indicated by the arrow C of FIG. 1.
Figure 3A:
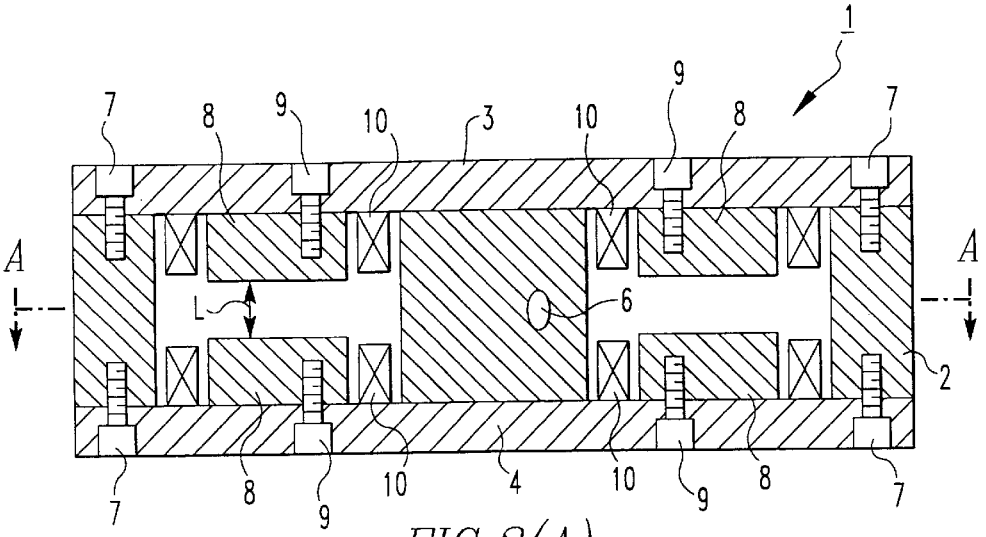
FIG.3(A) PRIOR ART
FIG. 3(A) is a cross-sectional view of the prior art omega filter that is a kind of energy filter.
Figure 3B:
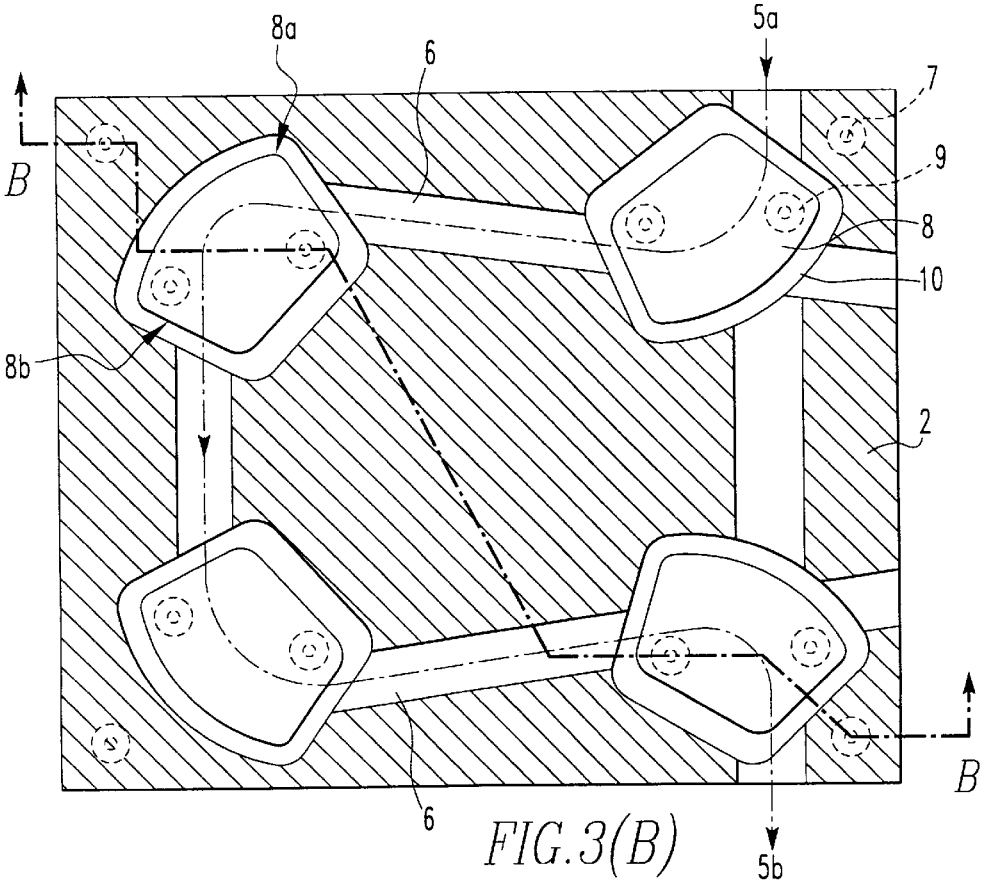
FIG.3(B) PRIOR ART
FIG. 3(B) is a cross-sectional view taken on line A—A of FIG. 3(A).

Referring to FIGS. 1, 2(A), 2(B) and 2(C), there is shown an energy filter embodying the concept of the present invention. FIG. 1 is a plan view of the energy filter. FIG. 2(A) is a cross-sectional view taken on line A—A of FIG. 1. FIG. 2(B) is a side elevation taken in the direction indicated by the arrow B of FIG. 1. FIG. 2(C) is a side elevation taken in the direction indicated by the arrow C of FIG. 1.

In FIG. 1, the omega filter, generally indicated by reference numeral 11, comprises a base plate 12 and four lenses 13 mounted on the base plate 12. An incident electron beam 5*a* is deflected by the action of the four lenses, travels in a passage 16 shaped like the letter "Q" and emerges as an electron beam 5*b* moving on the same straight line as the incident beam 5*a*.

Two arc-shaped polepieces 14 and 15 form magnetic poles of each lens 13. Two spacers 17 and 18 are sandwiched between the polepieces 14 and 15. These polepieces 14, 15 and the spacers 17, 18 are assembled into a unit with four screws 19. The length L of the gap between the two polepieces 14 and 15 is determined by the two spacers 17 and 18. A space surrounded by the polepieces 14, 15 and the spacers 17, 18 is used as the passage 16 for the electron beam. Grooves are formed in those portions of the polepieces 14, 15 which are in contact with the spacers 17, 18. Coils 20 are accommodated in these grooves to produce a magnetic field for deflecting the incident electron beam 5*a*.

A yoke 21 forming a magnetic path interconnecting the polepieces 14 and 15 is mounted to the side surfaces of the polepieces 14 and 15 with screws 22. Magnetic field leakage-preventing members 23 are mounted via spacers 24 with screws 25 to the entrance and exit, respectively, of the electron beam passage in the lens 13 to prevent unwanted leakage of the magnetic field. The entrance port for the incident beam 5*a* is indicated by 26. Openings 27 and 28 are used where the electron beam is made to travel straight without being deflected. The profile of each coil is indicated by 30.

The lenses 13 assembled accurately are separately placed in position on the base plate 12, using jigs or like, and mounted to the base plate with three screws 29. The base plate 12 has been previously placed in position accurately. Final checks are done to ascertain whether the length of the gap between the polepieces 14 and 15 mounted to the base plate 12 has an intended value and whether these polepieces are mounted at intended angles. If these requirements are not satisfied, the dimensional accuracies and positions of the lenses 13 can be easily modified after detaching the screws 29 and 19.

After completion of the modifications, a cover (not shown) is mounted on the base plate 12 so as to cover it totally. The spacer where the lenses 13 are accommodated is maintained as a vacuum by this cover and the base plate 12.

In the present invention, the lenses 13 are rigidly mounted to the base plate 12 and so the dimensional accuracies of the polepieces 14 and 15 can be easily inspected. Furthermore, the positions of the lenses can be readily readjusted separately because the lenses 13 are separately mounted to the base plate 12. Moreover, the lenses can be separately replaced.

It is to be noted that the present invention is not limited to the above embodiment but rather it is possible for those skilled in the art to make various modifications. For example, in the above embodiment, an omega filter using four lenses is described. No limitations are placed on the number of the lenses used. The invention is applicable to every type of energy filter, such as Wien-type filter, gamma-type filter and alpha-type filter, having polepieces that are required to be mounted accurately. As can be understood from the description provided thus far, the accuracies at which the polepieces forming the lenses are mounted can be easily checked. Also, the positions of the lenses can be readily readjusted separately.

Having thus described my invention with the detail and particularity required by the Patent Laws, what is desired protected by Letters Patent is set forth in the following claims.

What is claimed is:

1. An energy filter comprising:

a base plate;

a plurality of lenses mounted to said base plate, each lens comprised of two polepieces stacked on top of each other separated by two spacers and secured with screws; and said spacers and polepieces defining a passage therebetween.

2. The energy filter of claim 1, wherein said spacers are made of a nonmagnetic material.

3. The energy filter of claim 1, wherein a yoke made of a magnetic material is mounted to side surfaces of said two polepieces with screws to form a magnetic path.

4. The energy filter of claim 1, wherein said energy filter is an omega filter, and wherein four lenses are mounted on said base plate to form a passage shaped like the letter "Q".

* * * * *